US007829485B2

(12) United States Patent
Mikura

(10) Patent No.: US 7,829,485 B2
(45) Date of Patent: Nov. 9, 2010

(54) STRETCHABLE COMPOSITE FIBER

(75) Inventor: Masamichi Mikura, Kobe (JP)

(73) Assignee: Suetomi Engineering Co., Hyogo (JP)

( * ) Notice: Subject to any disclaimer, the term of this patent is extended or adjusted under 35 U.S.C. 154(b) by 164 days.

(21) Appl. No.: 11/822,524

(22) Filed: Jul. 6, 2007

(65) Prior Publication Data

US 2008/0020666 A1 Jan. 24, 2008

(30) Foreign Application Priority Data

Jul. 12, 2006 (JP) ..... 2006-191609

(51) Int. Cl.

| | |
|---|---|
| ***D04H 3/00*** | (2006.01) |
| ***D02G 3/04*** | (2006.01) |
| ***D02G 3/32*** | (2006.01) |
| ***D02G 3/38*** | (2006.01) |
| ***B32B 27/02*** | (2006.01) |

(52) U.S. Cl. ..... 442/361; 442/362; 442/364; 57/210; 57/225; 57/226; 57/227; 57/244; 428/371; 428/373; 428/374

(58) Field of Classification Search ..... None
See application file for complete search history.

(56) References Cited

U.S. PATENT DOCUMENTS

| | | | | |
|---|---|---|---|---|
| 2,387,320 | A * | 10/1945 | Foster | 57/211 |
| 6,677,038 | B1 * | 1/2004 | Topolkaraev et al. | 428/370 |
| 2003/0162458 | A1 | 8/2003 | Tsujiyama et al. | |
| 2004/0214498 | A1 * | 10/2004 | Webb et al. | 442/329 |

FOREIGN PATENT DOCUMENTS

| | | |
|---|---|---|
| JP | 5-131580 | 5/1993 |
| JP | 2004-250795 | 9/2004 |
| JP | 2006-22450 | 1/2006 |
| JP | 2006-504000 | 2/2006 |
| WO | 2004/038085 | 5/2004 |

OTHER PUBLICATIONS

Notice of Grounds for Rejection issued by the Japanese Patent Office for JP 2006-191609 drafted on Dec. 20, 2007 and its English translation.

* cited by examiner

*Primary Examiner*—Jennifer A Chriss
(74) *Attorney, Agent, or Firm*—Wenderoth, Lind & Ponack, L.L.P.

(57) ABSTRACT

An integral composite fiber is formed by integrally joining a stretchable fiber and unstretchable fibers. The stretchable fiber has longitudinally extending first exposed surfaces that are circumferentially spaced from each other. The unstretchable fibers has longitudinally extending second exposed surfaces each disposed between a circumferentially adjacent pair of the first exposed surfaces. One of the first exposed surfaces has a larger surface area than the other or others of the first exposed surfaces. Said other or each of the others of the first exposed surfaces has a surface area ratio of less than 0.8 with respect to the surface area of said one of the first exposed surfaces. By longitudinally stretching this integral composite fiber, because shear stress is large due to a large difference in shrinkage stress between said one of the first exposed surfaces and the other or others of the first exposed surfaces, the unstretchable fibers easily separate from the stretchable fiber, and are three-dimensionally crimped. The unshrinkable fibers are thus helically wrapped around and covers the shrinkable fiber, which has a rubber-like feel to the touch. Thus, the composite fiber obtained is bulky and feels good to the touch.

6 Claims, 12 Drawing Sheets

STRETCHABLE COMPOSITE FIBER

BACKGROUND OF THE INVENTION

This invention relates to a stretchable composite fiber, and a yarn and a nonwoven fabric containing such composite fibers.

A composite fiber is known which comprises a stretchable fiber and unstretchable fibers that are made of an elastic polymer and an inelastic polymer, respectively, that are insoluble in each other. The stretchable and unstretchable fibers have first and second exposed surfaces, respectively, that are arranged circumferentially alternately with each other.

It is possible to form a stretchable nonwoven fabric by forming a fiber web from such composite fibers, and stretching the web in at least one direction, thereby separating the stretchable and unstretchable fibers from each other (see JP patent publication 2006-22450). Such a nonwoven fabric is characterized by its improved feel to the touch compared to a nonwoven fabric consisting only of stretchable fibers, because the stretchable fibers, which have a rubber-like feel to the touch, are partially covered by the unstretchable fibers, which feel good to the touch.

But as shown in FIGS. 10A and 10B, a composite fiber 40 used as a material for e.g. a conventional stretchable nonwoven fabric comprises a stretchable fiber 41 and a plurality of unstretchable fibers 42 arranged symmetrically on the outer surface of the stretchable fiber at constant intervals and integrally joined to the stretchable fiber.

Thus, when this composite fiber is stretched, uniform shear stress acts on the interfaces of the stretchable fiber 41 and the respective unstretchable fibers 42, so that the unstretchable fibers 42 are subjected to less strain and thus cannot be efficiently separated from the stretchable fiber. Thus, the unstretchable fibers were often not completely separated from the stretchable fiber. Because separation of the stretchable fibers is incomplete, with the non-stretchable fibers partially joined to the stretchable fiber, the composite fiber 40 is not sufficiently stretchable when stretched.

Because efficiency of separation is low, it was impossible to sufficiently reduce the fineness of the composite fiber 40. This is because if the fineness is increased, the degree of stretchability of the stretchable fiber 41 also decreases, so that it becomes difficult to separate the unstretchable fibers 42 from the stretchable fiber 41.

Also, because the unstretchable fibers 42 are subjected to less strain, they are not crimped so markedly, so that the composite fiber is less bulky even after the unstretchable fibers are separated from the stretchable fiber. Thus, the composite fiber 40 is less voluminous even after it is stretched.

Further, as shown in FIG. 11, because the unstretchable fibers 42 are not sufficiently wrapped around the stretchable fiber 41, the area of the surface of the stretchable fiber 41 that is directly brought into contact with hands and fingers tends to be large, so that this composite fiber still has a rubber-like feel to the touch.

An object of the present invention is to provide a stretchable composite fiber which is high in stretchability, voluminous, good to the touch and can be produced efficiently.

SUMMARY OF THE INVENTION

According to the present invention, there is provide a stretchable composite fiber formed by forming an integral composite fiber comprising a stretchable fiber and unstretchable fibers that are integrally joined together, the stretchable fiber having longitudinally extending first exposed surfaces that are circumferentially spaced from each other, the unstretchable fibers having longitudinally extending second exposed surfaces each disposed between a circumferentially adjacent pair of the first exposed surfaces, wherein one of the first exposed surfaces has a larger surface area than the other or others of the first exposed surfaces, the other or each of the others of the first exposed surfaces having a surface area ratio of less than 0.8 with respect to the surface area of the one of the first exposed surfaces, and by stretching the integral composite fiber in the longitudinal direction thereof, thereby separating the stretchable fiber and the unstretchable fibers from each other, and causing the unstretchable fibers to be three-dimensionally crimped and helically twisted around the stretchable fiber.

The stretchable fiber may have a single first exposed surface. In this case, the single first exposed surface can be considered as one of the plurality of first exposed surfaces having the largest surface area and the remaining first exposed surfaces have zero surface area. Thus, in this case, too, the area ratio of each of the other first exposed surfaces to the single first exposed surface is less than 0.8, i.e. zero.

Because there is the surface area difference between the exposed surfaces of the stretchable fiber, when the composite fiber is stretched, the respective exposed surfaces are subjected to different shrinkage stresses. Thus, different shear stresses act on the interfaces between stretchable fiber and the respective unstretchable fibers. This causes the unstretchable fibers to be subjected to large strains, which in turn allows easy separation of the unstretchable fibers from the stretchable fiber. Because the unstretchable fibers substantially completely separate from the stretchable fiber, the stretchability of the composite fiber improves compared to conventional such fibers.

Because the other or each of the others of the first exposed surfaces has a surface area ratio of less than 0.8, preferably less than 0.5, with respect to the surface area of the one of the first exposed surfaces (this ratio is zero if the stretchable fiber has a single exposed surface), the shrinkage stresses that act on the respective exposed surfaces differ widely from each other, so that the shear stress increases, thus improving the efficiency of separation. Due to high efficiency of separation, it is possible to reduce the fineness of the composite fiber compared to conventional such fibers, thereby making the fiber finer and smoother.

Due to the strains, the unstretchable fibers are three-dimensionally crimped after separation, thus making the composite fiber bulky and voluminous.

The three-dimensionally crimped unstretchable fibers are helically wrapped around the stretchable fiber, so that the unstretchable fibers cover a greater area of the stretchable fiber than with conventional composite fibers.

Because the unstretchable fibers are separable from the stretchable fiber simply by stretching the composite fiber, the stretchable composite fiber according to the present invention can be produced efficiently at a relatively low cost.

After stretching such composite fibers, such composite fibers alone or such composite fibers and other fibers may be twisted together to form a stretchable yarn. Also, such composite fibers alone or such composite fibers and other fibers may be twisted together to form a nonwoven fabric, and the nonwoven fabric may be stretched to form a stretchable nonwoven fabric.

If the content of the stretchable fiber per 100% by weight of the entire stretchable composite fiber is too low, the shrinkage stress tends to be too low, thus making it difficult to separate the unstretchable fibers from the stretchable fibers, which in turn makes it difficult for the unstretchable fibers to be wrapped around the stretchable fiber.

If the content of the shrinkable fiber per 100% by weight of the entire stretchable composite fiber is too high, it is difficult to erase the rubber-like feel to the touch which is possessed by the elastic polymer. Thus, by limiting the content of the stretchable fiber per 100% by weight of the entire shrinkable composite fiber to 30 to 90% by weight, preferably 40 to 80% by weight, the unstretchable fibers can be more efficiently wrapped around the stretchable fiber, and the feel to the touch improves too.

The stretchable composite fiber preferably contains at least one of hydrophilic components, antimicrobial components and deodorant components so that the fiber has hydrophilic, antimicrobial and/or deodorant functions.

By forming a composite fiber from a stretchable fiber and unstretchable fibers in the above-described manner, and stretching it, it is possible to efficiently produce a shrinkable composite fiber of which the unstretchable fibers are helically wrapped around the stretchable fiber. The thus formed stretchable composite fiber is bulky, feels good to the touch, and pleasant to the eye.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENTS

Now the embodiment of the present invention is described with reference to the drawings.

Figure 1:
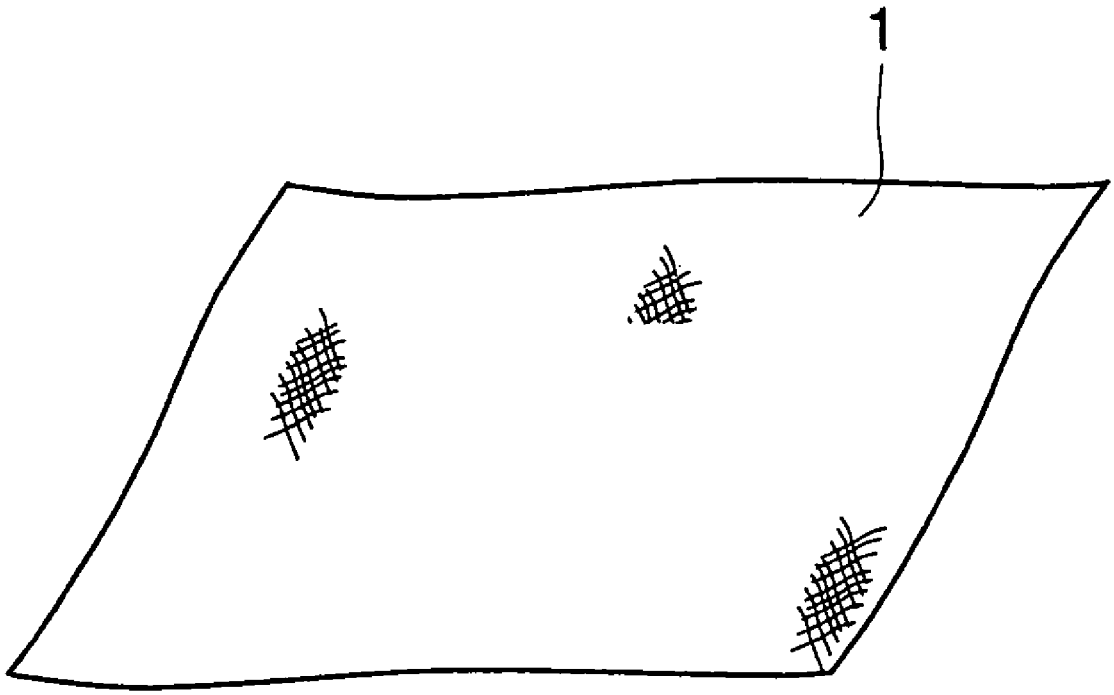
FIG. 1 shows an entire stretchable nonwoven fabric embodying the present invention.

The stretchable nonwoven fabric 1 according to the embodiment of FIG. 1 is formed from material A comprising an elastic thermoplastic polymer, and material B comprising an inelastic thermoplastic polymer. Materials A and B are insoluble in each other.

Material A is preferably one of elastic thermoplastic polymers of the urethane, styrene, ester, ethylene, vinyl chloride and nylon families, or a mixture thereof. On condition that such elastic thermoplastic polymer or polymers constitute a major portion of material A, material A may additionally contain several percent of inelastic thermoplastic polymers.

Material B is preferably one of inelastic thermoplastic polymers of the polyester, polyolefin, nylon and polyvinyl alcohol families, or a mixture thereof. On condition that such inelastic thermoplastic polymer or polymers constitute a major portion of material B, material B may additionally contain several percent of elastic thermoplastic polymers.

Hydrophilic agents, antimicrobials, deodorants, etc. may be kneaded into either of materials A and B. Such hydrophilic agents include water-soluble polymers such as stearates, sodium sulfonates and polyethylene oxide, and are preferably added to one or each of materials A and B by about 0.2 to 7.0% by weight. The above antimicrobials and deodorants include titanium oxide, white carbon, silver compounds, zeolite and bamboo extracts, and are preferably added to one or each of materials A and B by about 0.2 to 2.0% by weight.

Figure 2:
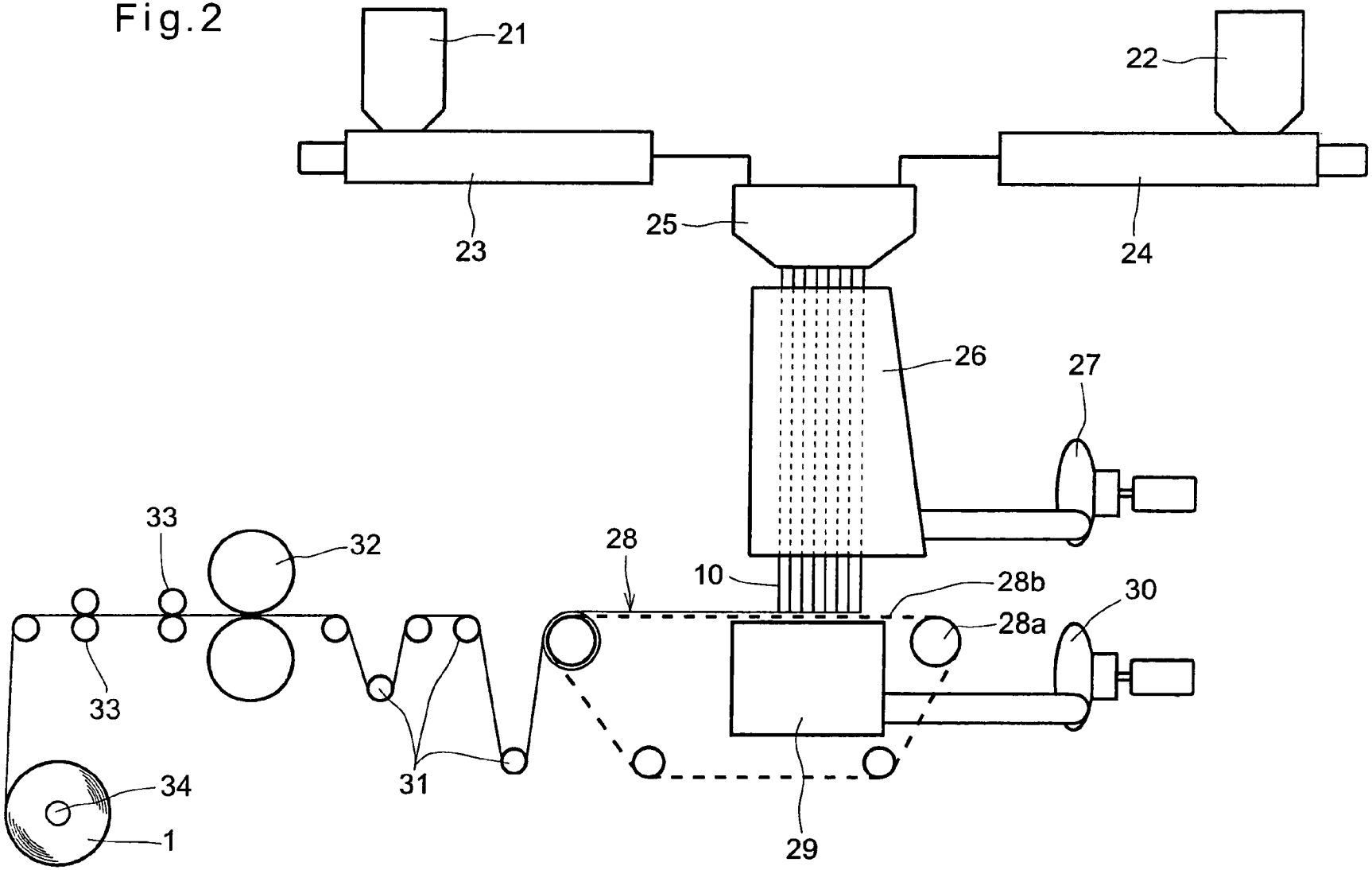
FIG. 2 shows the production steps of the stretchable nonwoven fabric.

The stretchable nonwoven fabric 1 is formed from materials A and B following the steps shown in FIG. 2. As shown, materials A and B are first put into hopers 21 and 22, respectively, heated and melted in respective extruders 23 and 24, and fed into a die 25. Materials A and B flow through vertical passages formed in the die 25. In the bottom of the die 25, substantially circular minute nozzle openings 25*a* are formed so as to be arranged in rows and columns.

Figure 3A:
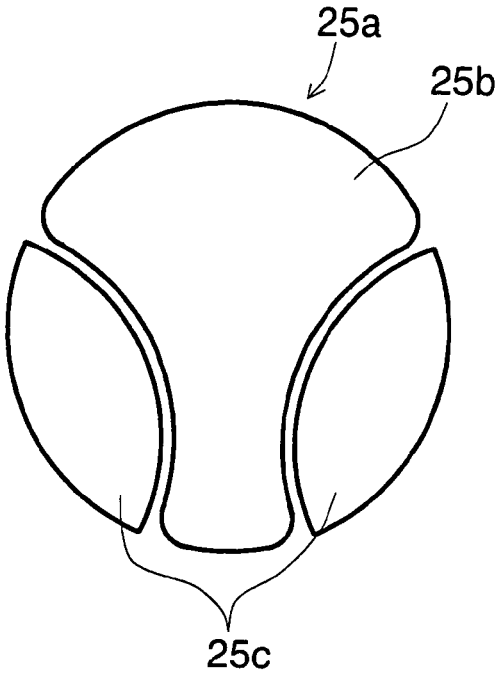
FIGS. 3A to 3C are enlarged views of die openings.
Figure 3B:
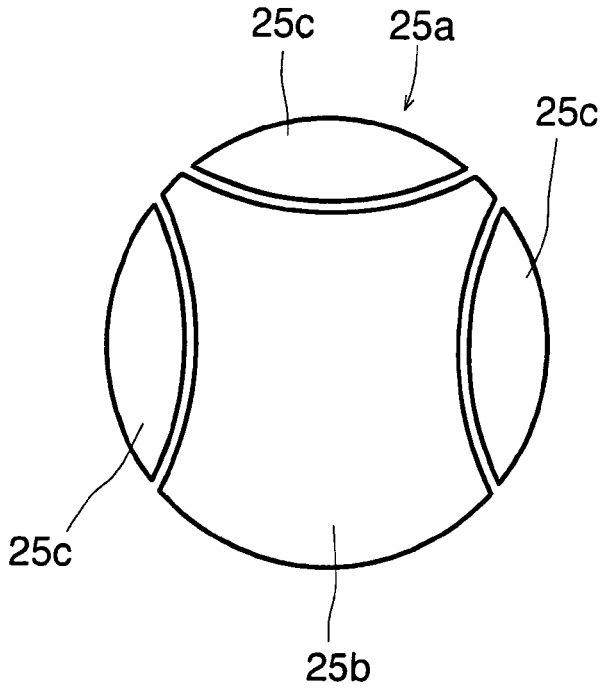
Figure 3C:
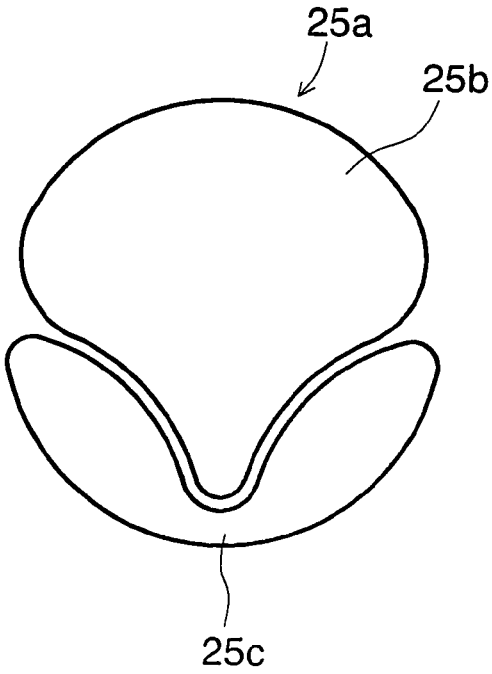

The nozzle openings 25*a* may be shaped as shown in FIGS. 3A to 3C. The nozzle opening 25*a* shown in FIG. 3A comprises a substantially dovetail-shaped central portion 25*b* and substantially oval side portions 25*c* disposed on both sides of the central portion 25*b* and having pointed tips at both ends of their major axes. The nozzle opening shown in FIG. 3B comprises a substantially square central portion 25*b* having three arcuate concave sides and one arcuate convex side, and three substantially oval side portions 25*c* each provided along one of the arcuate concave sides of the central portion 25*b* and having pointed tips at both ends of its major axis. The nozzle opening shown in FIG. 3C comprises a substantially ginkgo leaf-shaped central portion 25*b*, and a bilobed side portion 25*c* provided along the bottom edge of the central portion 25*b*.

Molten material A is fed into the central portion 25*b* of each nozzle opening 25*a* from the extruder 23, while molten material B is fed into the side portion or portions 25*c* of each nozzle opening 25*a* from the extruder 24. Thus, stretchable fibers 11 made of an elastic thermoplastic polymer are spun from the central portions 25*b* of the nozzle openings 25*a*, while unstretchable fibers 12 made of an inelastic thermoplastic polymer are spun from the side portions 25*c* of the nozzle openings 25*a*. As soon as the fibers 11 and 12 are spun, they are joined together in a molten state.

With the fibers 11 and 12 joined together, because materials A and B are insoluble in each other, they never melt into each other or mix with each other. Thus, according to the shape of the nozzle openings 25*a* of the die 25, composite fibers 10 as shown in FIGS. 4A to 4C are formed, of which the stretchable and unstretchable fibers 11 and 12 are alternately exposed to the surface.

Figure 4A:
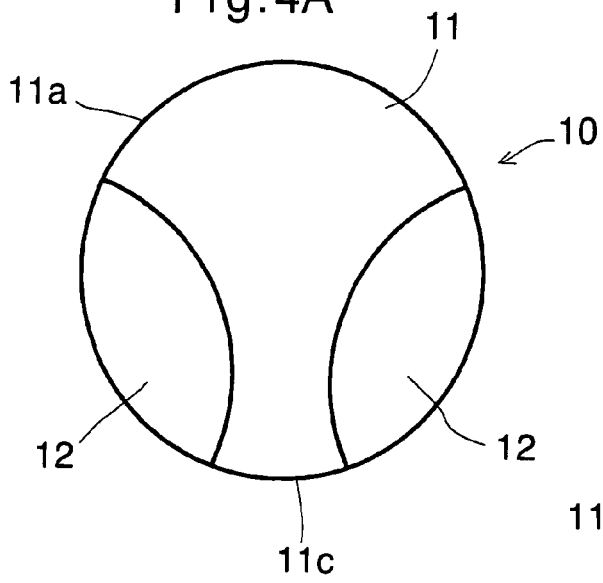
FIGS. 4A to 4C are sectional views of composite fibers.

The stretchable fiber 11 of FIG. 4A has two separate portions 11*a* and 11*c* that are exposed to the surface of the composite fiber 11. The stretchable fiber of FIG. 4B has three such exposed portions 11*b*, 11*d* and 11*e*, and the stretchable fiber of FIG. 4C has one such exposed portion 11*f*. The ratio of materials A and B, and the like are adjusted so that the content of the stretchable fiber 11 is 30 to 90% by weight based on 100% by weight of the entire composite fiber 10.

Figure 4B:
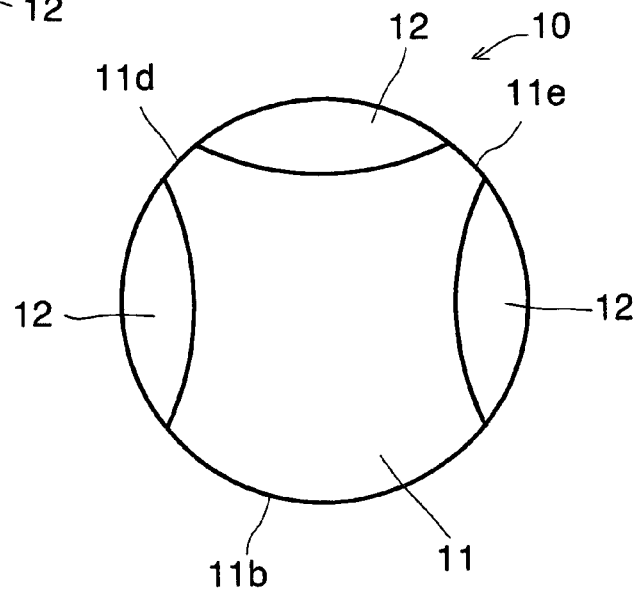
Figure 4C:
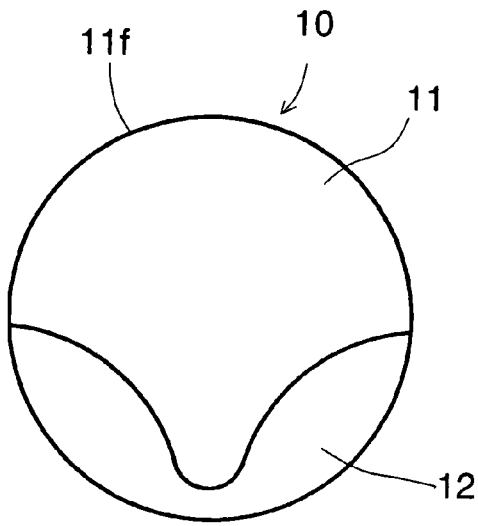

As shown in FIGS. 4A and 4B, of the exposed portions 11*a* to 11*e* of the stretchable fibers 11 of FIGS. 4A and 4B, the surface area ratios between the exposed portions 11*a* and 11*b*, i.e. the exposed portions having the largest surface areas of the respective fibers 11, and the other exposed portions 11*c*, 11*d* and 11*e* are determined so as to satisfy the following relations:

$S(11c)/S(11a)<0.8$ $S(11d)/S(11b)<0.8$ $S(11e)/S(11b)<0.8$ where S(11*a*) to S(11*d*) represent surface areas of the exposed portions 11*a* to 11*d*, respectively.

In the arrangement of FIG. 4C, of which the stretchable fiber 11 has only one exposed portion 11*f*, it can be considered that the stretchable fiber 11 has a second exposed portion having a zero surface area. Thus, the surface area ratio of the second exposed portion to the exposed portion 11*f* is 0/S(11*f*) =0<0.8.

As shown in FIG. 2, the composite fibers 10 pass through a cooling chamber 26 provided under the die. From an air blower 27 connected to the cooling chamber 26, air is continuously blown into the chamber 26, thereby cooling the composite fibers 10 when they pass through the chamber 26.

As shown in FIG. 2, a collecting conveyor 28 is provided under the cooling chamber 26. The collecting conveyor 28 comprises a pulley 28*a* and a net-like endless belt 28*b* driven by the pulley 28*a*. The conveyor 28 contains a suction box 29 to which a suction blower 30 is connected so that a suction force is applied to the endless belt 28*b* by the suction box 29. Thus, after passing through the cooling chamber 26, the composite fibers 10 are sucked to and deposited on the collecting conveyor 28. The fibers 10 are thus formed into a fiber web on the conveyor, which is fed toward the discharge end of the conveyer 28 by the moving endless belt 28*b*.

After being discharged from the discharge end of the conveyor 28, the fiber web is guided by guide rollers 31 into between a pair of heated embossing rollers 32. The fiber web is point-bonded when sandwiched between the heated embossing rollers 32*a* and formed into a fiber sheet.

The fiber sheet is then fed into between two pairs of nip rollers 33. The fiber sheet is stretched by a predetermined amount, preferably by 70% or more, when sandwiched between the nip rollers 33, and then released.

Figure 5:
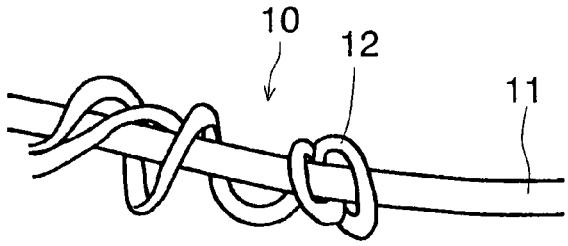
FIG. 5 is a sectional view of a composite fiber.

When the sheet is stretched, due to the above-described difference in surface area, large shear stress is produced at the interface between the stretchable fibers 11 and the unstretchable fibers 12, so that the fibers 11 and 12 are smoothly separated from each other. Also, as shown in FIG. 5, the unstretchable fibers 12 are three-dimensionally crimped, so that the fibers 12 are helically twisted around the stretchable fiber 11. The stretchable nonwoven fabric 1 thus obtained is therefore sufficiently bulky and voluminous, highly stretchable, and feels good to the touch with no rubber-like feel to the touch.

The stretchable nonwoven fabric 1 is wound onto a winder roller 34, cut, if necessary, and used.

In this embodiment, the composite fibers 10 are formed into the nonwoven fabric 1. But instead, a composite fiber 10 which is also formed from molten spun yarn may be formed into a stretchable composite fiber by e.g. directly feeding the fiber 10 into between two pairs of nip rollers to stretch it in the longitudinal direction, thereby splitting the fiber into a stretchable fiber 11 and an unstretchable fiber or fibers 12. By twisting together such stretchable composite fibers alone or such stretchable composite fibers and other fibers, a stretchable yarn is obtained. Further, a woven fabric can also be produced by weaving such yarns on a loom.

In the embodiment, the composite fiber 10 has a circular cross-section. But its cross-section is not limited to circular but may be polygonal or doughnut-shaped. The composite fiber 10 according to the present invention, which comprises the stretchable fiber 11 and the unstretchable fiber or fibers 12, is not limited in structure to those of the embodiment but may be designed freely, provided the above-mentioned relations of surface areas, weight ratios, etc. are met.

EXAMPLES

More detailed Examples of the invention and Comparative Examples are described to further clarify the present invention.

As the elastic thermoplastic polymer, a polyurethane resin having a hardness of about 80 was prepared, and as the inelastic thermoplastic polymer, a polypropylene resin having a melt flow rate (MFR) of about 30 was prepared.

Figure 6A:
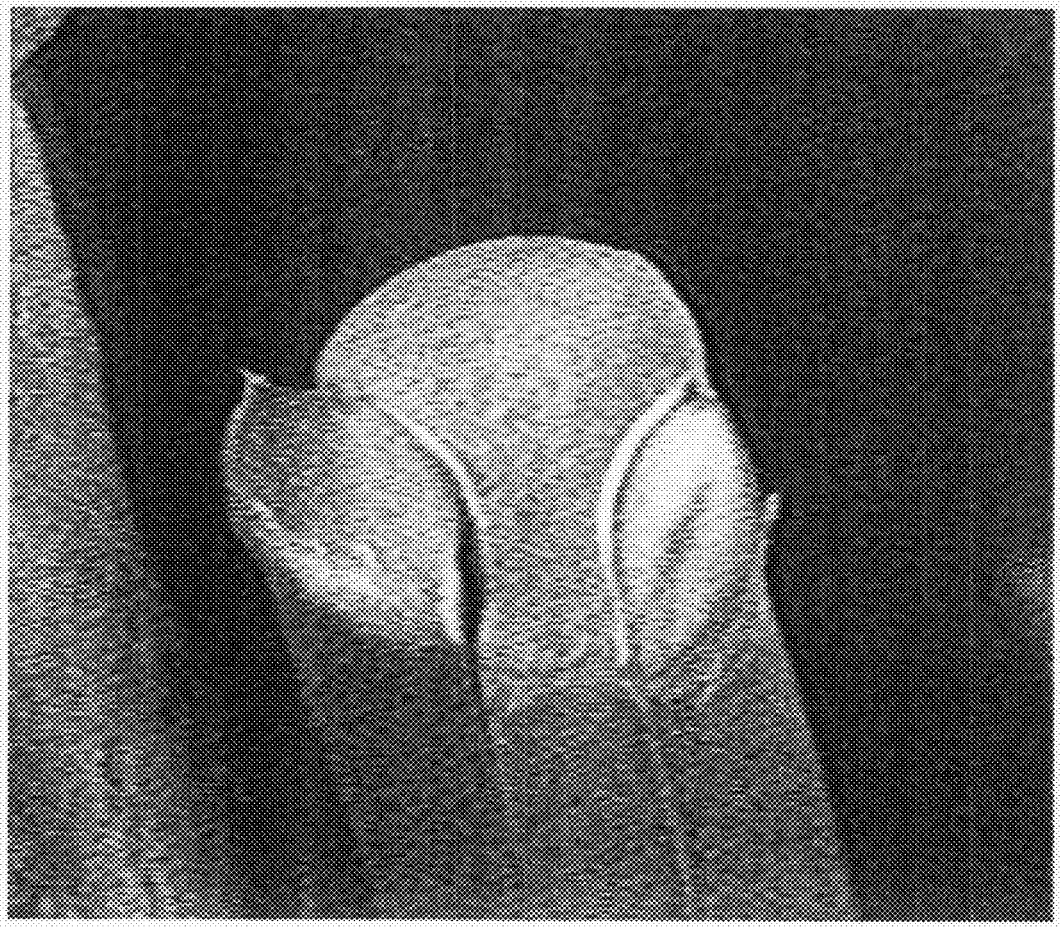
FIGS. 6A to 6C are photos of sections of composite fibers according to Examples of the invention.
Figure 6B:
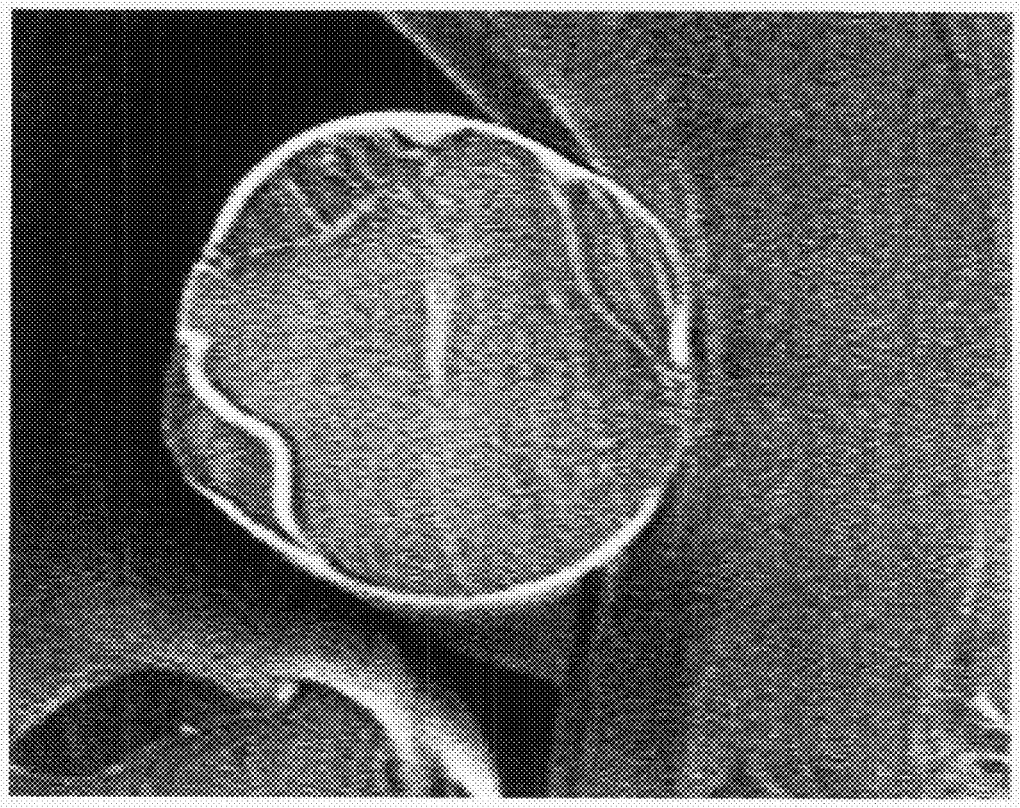
Figure 6C:
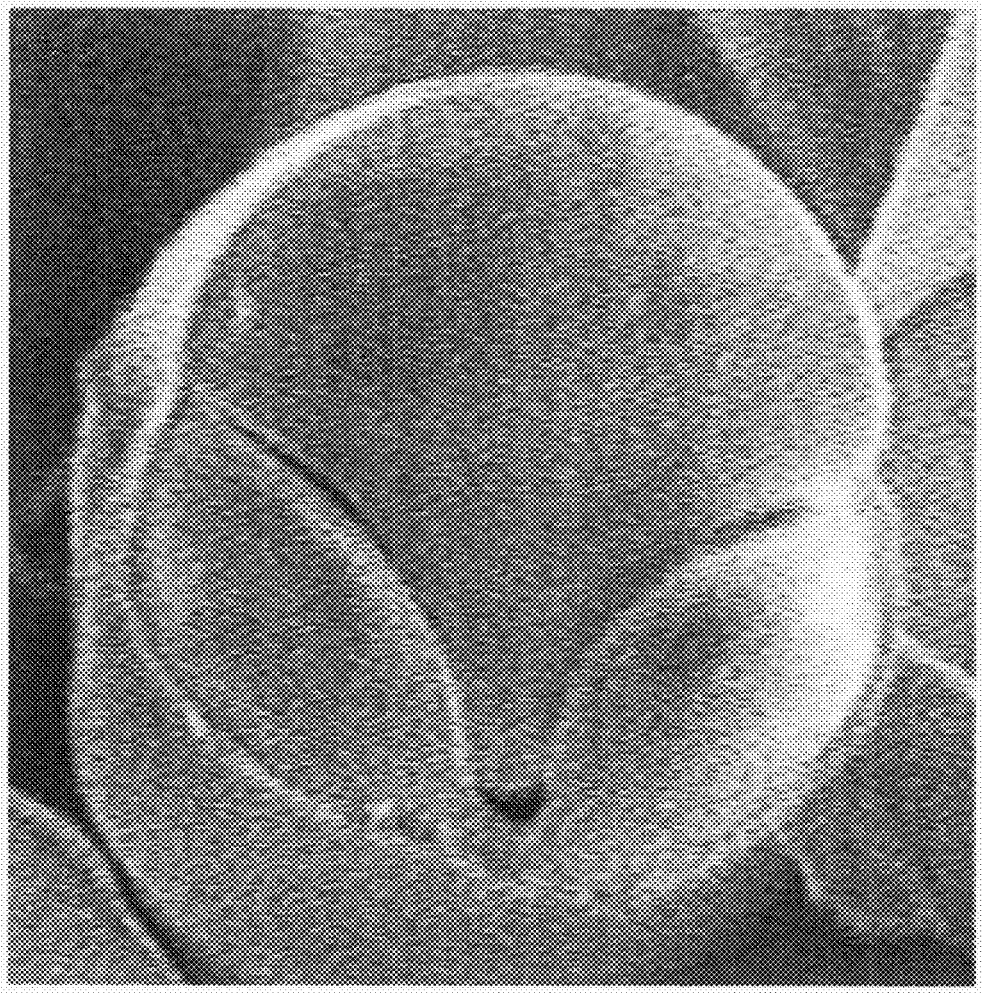
Figure 7A:
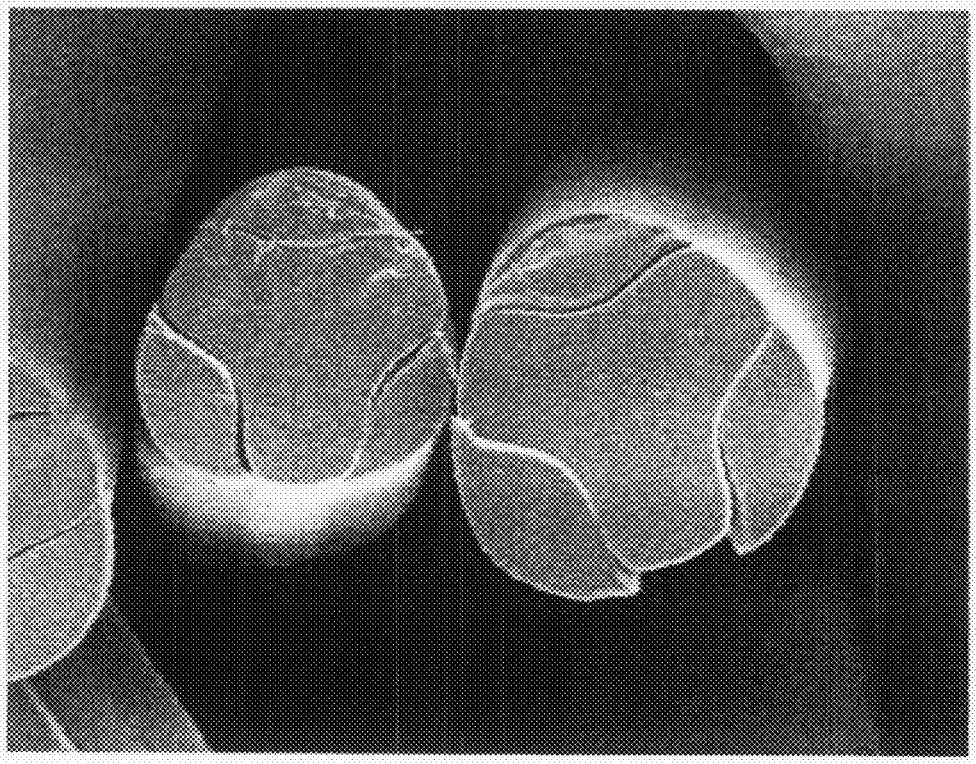
FIGS. 7A and 7B are photos of sections of composite fibers according to Comparative Examples.
Figure 7B:
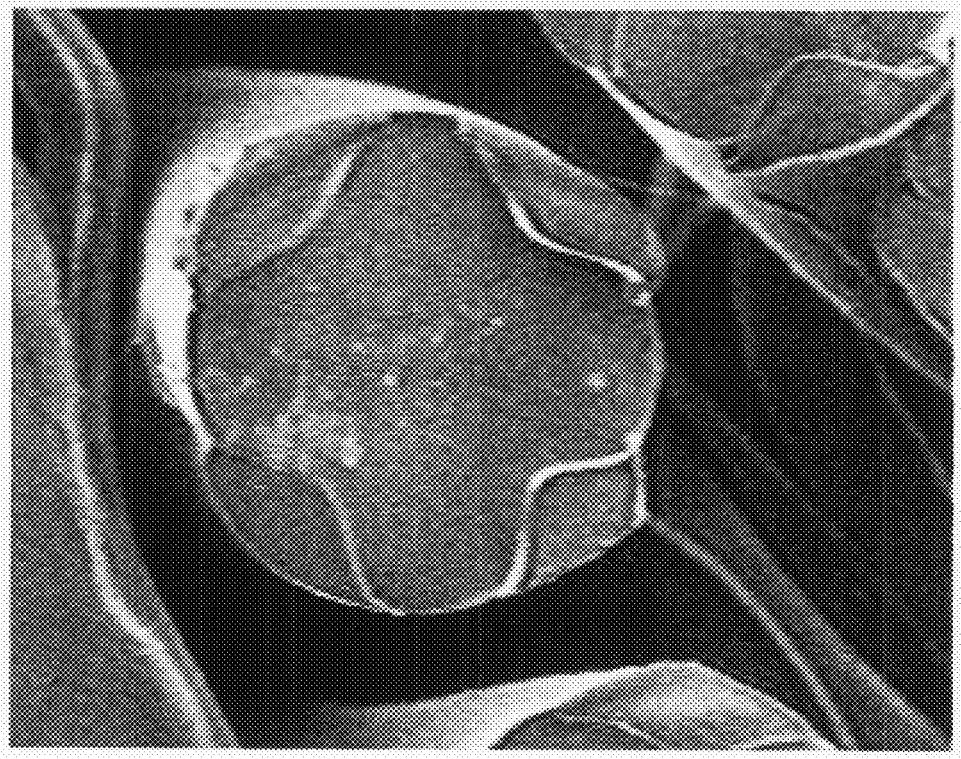

From these resins, composite fibers of about 4 deniers according to Examples 1, 2 and 3, which have the cross-sections shown in FIGS. 6A, 6B and 6C, were formed in the manner outlined in the description of the embodiment. Composite fibers of about 4 deniers as Comparative Examples 1 and 2, which have the cross-sections shown in FIGS. 7A and 7B, were also formed.

The structures of the composite fibers of Examples of the invention and Comparative Examples are shown in Table 1. Each figure in the column of Rw in the table is the weight ratio (%) of the fiber made of the polyurethane resin to the entire composite fiber. Each figure in the column of Rs in the table is the ratio (%) of the surface area of one of the portions of the polyurethane resin fiber exposed to the surface of the composite fiber and having the largest surface area to the surface area of the other exposed portion or each of the other exposed portions. Each figure in the column of St in the table is the residual strain (%) in the composite fiber. As is apparent from the table, the composite fibers according to Examples of the invention are extremely small in residual strain compared to those of Comparative Examples.

TABLE 1

| | $R_w$ | $R_s$ | $S_t$ |
|---|---|---|---|
| Example 1 of the invention | 60 | 23 | 5.7 |
| Example 2 of the invention | 75 | 15, 13 | 3.9 |
| Example 3 of the invention | 50 | 0 | 4.7 |
| Comparative Example 1 | 60 | 92 | 67.8 |
| Comparative Example 2 | 75 | 78, 82, 85 | 32.5 |

The composite fibers of Examples of the invention and Comparative Examples were laminated on belt conveyors to form fiber webs, as in the embodiment. The webs were point-bonded together with heated embossing rollers to obtain fiber sheets that weigh 80 grams per square meter. The thus obtained fiber sheets were guided into between two pairs of nip rollers to stretch them by 150%, thereby forming stretchable nonwoven fabrics of Examples of the invention and Comparative Examples.

Figure 8:
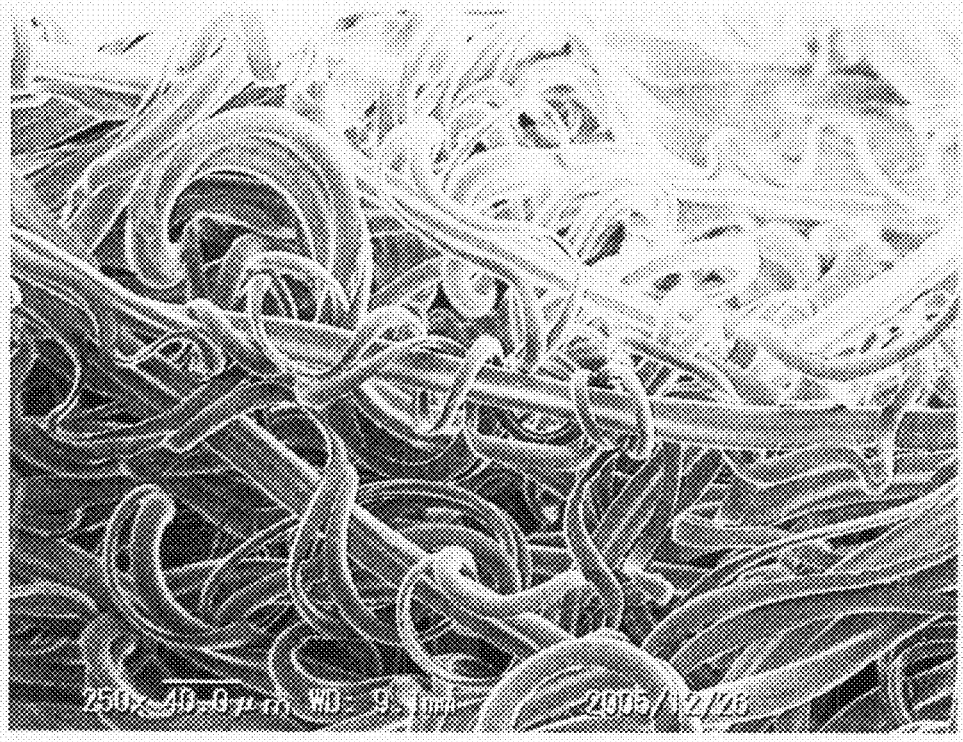
FIG. 8 is an enlarged photo of a nonwoven fabric of Example of the invention.
Figure 9:
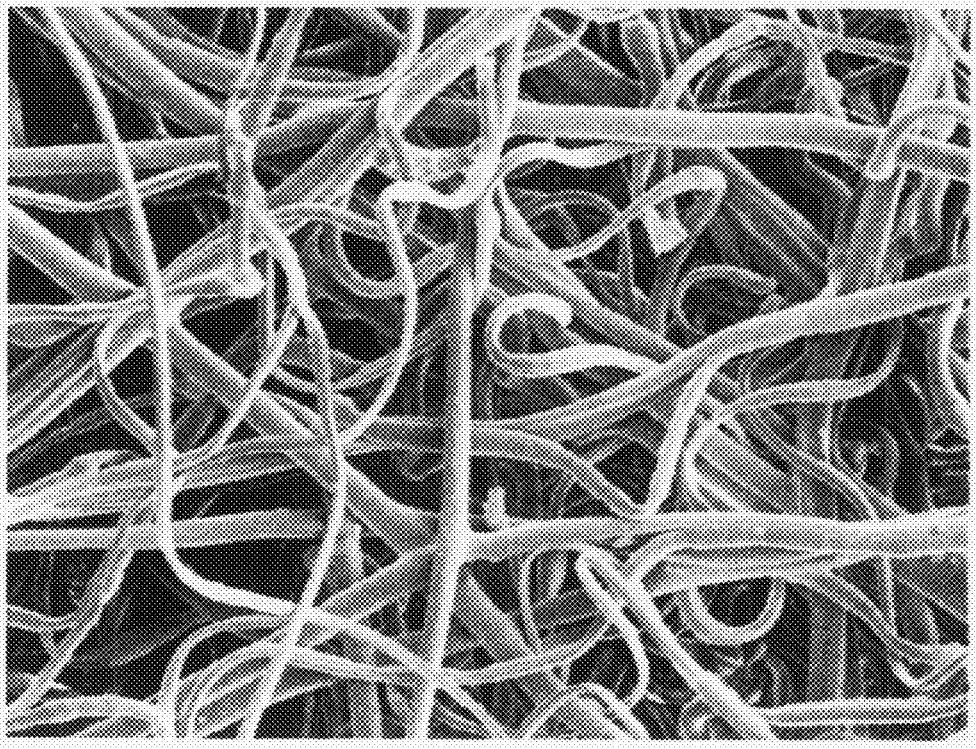
FIG. 9 is an enlarged photo of a nonwoven fabric of Comparative Example.
Figure 10A:
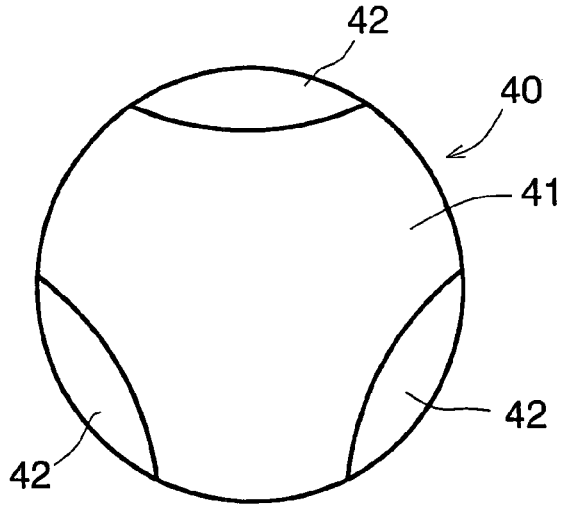
Fig.10A Prior Art
FIGS. 10A and 10B are sectional views of conventional composite fibers.
Figure 10B:
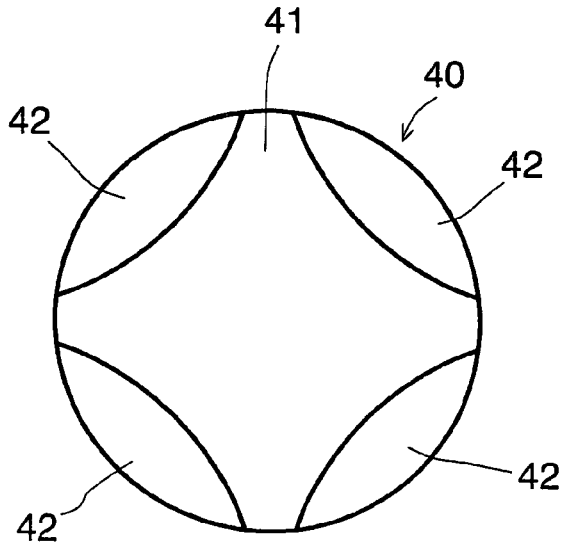
Fig.10B Prior Art
Figure 11:
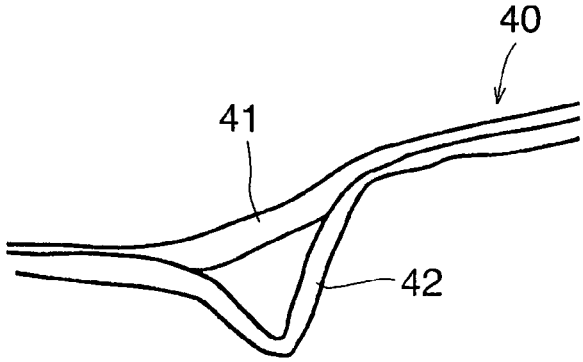
Fig.11 Prior Art
FIG. 11 is a plan view of a conventional stretchable composite fiber.

FIG. 8 shows an enlarged photo of a thus obtained stretchable nonwoven fabric of Example of the invention, and FIG. 9 shows an enlarged photo of a thus obtained stretchable nonwoven fabric of Comparative Example.

As is apparent from FIG. 8, in the stretchable nonwoven fabrics of Examples of the invention, the polypropylene fibers are three-dimensionally crimped, and helically wrapped around the polyurethane fibers.

Because the polypropylene fibers are three-dimensionally crimped, the fabrics are bulky and voluminous, and feel good to the touch with no rubber-like feel to the touch because the polypropylene fibers are helically wrapped around the polyurethane fibers. Because the fibers are substantially completely separated from each other, they were stretched to a high degree.

On the other hand, in the stretchable nonwoven fabrics of Comparative Examples, as shown in FIG. 9, the polypropylene fibers are only two-dimensionally crimped, so that the fabrics are less voluminous because the polypropylene fibers are not wrapped around the polyurethane fibers. Also, as is apparent from FIG. 9, the polypropylene fibers and polyurethane fibers are not sufficiently separated from each other but they are partially joined together, so that the fabrics were not stretched sufficiently.

From these results, it was discovered that the stretchable nonwoven fabrics of Examples of the invention were superior to conventional such fabrics in voluminousness, feel to the touch and degree of expansion.

What is claimed is:

1. A stretchable composite fiber formed:

by forming an integral composite fiber having a circular cross-section having a center, comprising a stretchable fiber and unstretchable fibers that are integrally joined together, said stretchable fiber contains the center and has longitudinally extending first exposed surfaces that are circumferentially spaced from each other, said unstretchable fibers are radially outwardly spaced from the center and have longitudinally extending second exposed surfaces each disposed between a circumferentially adjacent pair of said first exposed surfaces, and said unstretchable fibers are spaced from each other by the stretchable fiber;

wherein one of said first exposed surfaces has a larger surface area than the other or others of said first exposed surfaces, said other or each of said others of said first exposed surfaces having a surface area ratio of less than 0.8 with respect to the surface area of said one of said first exposed surfaces; and by stretching said integral composite fiber in the longitudinal direction thereof, thereby separating said stretchable fiber and said unstretchable fibers from each other, and causing said unstretchable fibers to be three-dimensionally crimped and helically twisted around said stretchable fiber;

wherein the unstretchable fibers are not present in the center of the composite fiber, and the composite fiber has only one single stretchable fiber component.

2. The stretchable composite fiber of claim 1 wherein said stretchable fiber accounts for 30 to 90% by weight of the entire stretchable composite fiber.

3. The stretchable composite fiber of claim 1 which contains at least one of hydrophilic components, antimicrobial components and deodorant components.

4. A stretchable yarn formed of a plurality of the stretchable composite fibers of claim 1 that are twisted together.

5. A nonwoven fabric comprising a plurality of the stretchable composite fibers of claim 1.

6. The stretchable composite fiber of claim 1 wherein the stretchable fiber comprises an integral, monolithic member.

* * * * *